US006468391B1

(12) United States Patent
Sharyo et al.

(10) Patent No.: US 6,468,391 B1
(45) **Date of Patent: *Oct. 22, 2002**

(54) METHOD OF MAKING SANITARY PAPER FROM CHEMICAL PULP USING A SINGLE COMPONENT CELLULASE THAT DOES NOT CONTAIN CELLULOSE-BUILDING DOMAIN

(75) Inventors: Masaki Sharyo, Matsudo (JP); Hiromichi Sakaguchi, Chiba (JP); Masahiro Ohishi, Chiba (JP); Mamoru Takahashi, Kanagawa (JP); Katsunori Kida, Kanagawa (JP); Hitoshi Tamagawa, Kanagawa (JP); Martin Schulein, Copenhagen (DK); Neal Franks, Raleigh, NC (US)

(73) Assignee: Novozymes A/S, Bagsvaerd (DK)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/104,678

(22) Filed: Jun. 25, 1998

Related U.S. Application Data

(63) Continuation of application No. PCT/DK97/00034, filed on Jan. 23, 1997.

(60) Provisional application No. 60/010,658, filed on Jan. 26, 1996.

(51) Int. Cl.[7] ..... D21C 3/20

(52) U.S. Cl. ..... 162/72; 162/149; 435/277; 435/278

(58) Field of Search ..... 162/72, 141, 149, 162/111; 435/277, 278

(56) References Cited

U.S. PATENT DOCUMENTS 5,620,565 A * 4/1997 Lazorisak et al. ..... 162/72

FOREIGN PATENT DOCUMENTS

| | | |
|---|---|---|
| JP | 5-148794 | 6/1993 |
| WO | WO 91/17243 | 11/1991 |
| WO | WO 95/24471 | 9/1995 |
| WO | WO/ 96/00811 | 1/1996 |

OTHER PUBLICATIONS

File WPI, Derwent Accession No. 93–224721, Sanyo Scott KK: "Sanitary Tissue With High Strength, Etc.—MFD, By Adding Cellulase To Plant Fibre Pulp Slurry And Making Into Paper Without Beating"; JP A, 5148794, 930615.

* cited by examiner

*Primary Examiner*—Steve Alvo
(74) *Attorney, Agent, or Firm*—Elias Lambiris; Jason Garbell

(57) ABSTRACT

Sanitary paper with improved softness (lower stiffness) can be obtained without significant loss of paper strength by using a papermaking pulp which is treated with a certain type of cellulase component. The cellulase component in question is characterized by not containing a cellulose-binding domain (CBD), and is more effective for making softer sanitary paper than a conventional cellulase preparation which contains a mixture of various cellulase components with and without a CBD.

22 Claims, No Drawings

METHOD OF MAKING SANITARY PAPER FROM CHEMICAL PULP USING A SINGLE COMPONENT CELLULASE THAT DOES NOT CONTAIN CELLULOSE-BUILDING DOMAIN

CROSS REFERENCE TO RELATED APPLICATIONS

This application is a continuation of PCT/DK97/00034 filed Jan. 23, 1997 and claims priority of U.S. provisional application Ser. No. 60/010,658, filed Jan. 26, 1996, the contents of which are fully incorporated herein by reference.

TECHNICAL FIELD

This invention relates to a method for making sanitary paper.

BACKGROUND ART

Sanitary paper such as toilet paper, facial tissue paper, paper napkin, wiper, paper towel, sanitary napkin, diaper etc. is commonly made from papermaking pulp. It is generally desirable to make the sanitary paper softer without reducing the paper strength.

Japanese laid-open patent application Tokkai Hei (JP-A) 5-148794 discloses that a treatment of the pulp with a cellulase preparation is effective for this purpose. The cellulase preparations described therein are produced by cultivation of microorganisms and are known to contain mixtures of various cellulase components with and without cellulose binding domains.

It is the purpose of this invention to improve the known process to achieve a better effect.

STATEMENT OF THE INVENTION

We have, surprisingly, found a certain type of cellulase component to be very effective in reducing the paper stiffness without significant loss of paper strength (or, in some cases, even with an increase of paper strength). The cellulase component in question is characterized by not containing a cellulose-binding domain (CBD), and is more effective than a conventional cellulase preparation which contains a mixture of various cellulase components.

Accordingly, the invention provides a method wherein a papermaking pulp is treated with a cellulase in the absence of a cellulose-binding domain. The treated pulp is used for making sanitary paper.

DETAILED DESCRIPTION OF THE INVENTION

Sanitary Paper

The sanitary paper produced according to the invention may be toilet paper, facial tissue paper, wiper, paper napkin, paper towel, sanitary napkin, diaper etc.

Papermaking Pulp

Any papermaking pulp conventionally used for the production of sanitary paper can be treated according to the invention. This pulp can be supplied as a virgin pulp, or can be derived from a recycled source.

The papermaking pulp may be a wood pulp, a non-wood pulp or a pulp made from waste paper. A wood pulp may be made from softwood such as pine, redwood, fir, spruce, cedar and hemlock or from hardwood such as maple, alder, birch, hickory, beech, aspen, acacia and eucalyptus. A non-wood pulp may be made, e.g., from bagasse, bamboo, cotton or kenaf. A waste paper pulp may be made by re-pulping waste paper such as newspaper, mixed office waste, computer print-out, white ledger, magazines, milk cartons, paper cups etc.

Preferably, the papermaking pulp to be treated comprises both hardwood pulp and softwood pulp. Advantageously, we have found that a cellulase without a cellulose-binding domain (CBD) used according to the invention is particularly effective for softening such a mixed pulp. Thus, the papermaking pulp may comprise comprise 5–95% (particularly 25–75% ) of softwood pulp and 5–95% (particularly 25–75%) of hardwood pulp (% of pulp dry matter).

The wood pulp to be treated may be mechanical pulp (such as ground wood pulp, GP), chemical pulp (such as Kraft pulp or sulfite pulp), semichemical pulp (SCP), thermomechanical pulp (TMP), chemithermomechanical pulp (CTMP), or bleached chemithermomechanical pulp (BCTMP).

The Kraft pulp to be treated may be a bleached Kraft pulp, which may consist of softwood bleached Kraft (SWBK, also called NBKP), hardwood bleached Kraft (HWBK, also called LBKP) or a mixture of these. A good softening effect according to the invention is seen with a mixture of NBKP and LBKP, e.g. with a eight ratio (on dry basis) of NBKP:LBKP in the range from 3:1 to 1:3. One preferred mixture consists of SWBK having a coarseness above 18 and HWBK having a coarseness above 10. Another preferred mixture consists of SWBK having a coarseness below 18 and HWBK having a coarseness below 10. The coarseness of the pulp is determined according to TAPPI method T271 (pm-91) and is expressed in units of mg per 100 m.

When treating a waste paper pulp, the cellulase treatment can take place during or after pulping of the waste paper. The cellulase treatment can simultaneously serve to release ink particles from the cellulose fibers, whereafter the released ink particles can be removed to obtain a de-inked pulp, as described in JP-A 59-9299, JP-A 63-59494, JP-A 2-80683, and JP-A 3-882.

The sanitary paper can be made from dried pulp. In this case, the cellulase treatment can be applied in the production of the dried pulp, or it can be applied during or after re-pulping (disintegration) of the dried pulp.

Cellulase without CBD

The invention uses a cellulase in the absence of a cellulose-binding domain (CBD). The term "cellulose" denotes an enzyme that contributes to the hydrolysis of cellulose, such as a cellobiohydrolase (Enzyme Nomenclature E.C. 3.2.1.91), an endo-glucanase (hereinafter abbreviated as "EG", E.C. 3.2.1.4), or a beta-glucosidase (E.C. 3.2.1.21).

Cellulose-binding domains have been described by P. Tomme et al. in J. N. Saddler & M. H. Penner (eds.), "Enzymatic Degradation of Insoluble Carbohydrates" (ACS Symposium Series, No. 618), 1996. A number of cellulases are known to contain a catalytic domain without a CBD; such a cellulase may be used as such in the invention. It is also known that other cellulases contain a catalytic domain and a CBD; such a cellulase may be truncated to obtain a catalytic core domain without the CBD, and this core may be used in the invention.

The cellulase used in this invention may be a single component, or a mixture of cellulases may be used, provided each cellulase has no CBD.

Cellulases may be classified into families on the basis of amino-acid sequence similarities according to the classification system described in Henrissat, B. et al.: *Biochem. J.,* (1991), 280, p. 309–16, and Henrissat, B. et al.: *Biochem. J.,*

(1993), 293, p. 781–788. Some preferred cellulases are those belonging to Family 5, 7, 12 and 45.

Family 5 Cellulase

A preferred Family 5 cellulase without CBD is an alkaline cellulase derived from a strain of Bacillus. One such Family 5 cellulase is the endo-glucanase from Bacillus strain KSM-64 (FERM BP-2886). The cellulase and its amino acid sequence are described in JP-A 4-190793 (Kao) and Sumitomo et al., *Biosci. Biotech. Biochem.,* 56 (6), 872–877 (1992).

Another Family 5 cellulase from Bacillus is the endo-glucanase from strain KSM-635 (FERM BP-1485). The cellulase and its amino acid sequence are described in JP-A 1-281090 (Kao) , U.S. Pat. No. 4,945,053 and Y. Ozaki et al., *Journal of General Microbiology,* 1990, vol. 136, page 1973–1979.

A third Family 5 cellulase from Bacillus is the endo-glucanase from strain 1139. The cellulase and its amino acid sequence are described in Fukumori F. et al., *J. Gen. Microbiol.,* 132:2329–2335 (1986) and JP-A 62-232386 (Riken).

Yet another preferred Family 5 cellulase without CBD is an endo-beta-1,4-glucanase derived from a strain of Aspergillus, preferably *A. aculeatus*, most preferably the strain CBS 101.43, described in WO 93/20193 (Novo Nordisk).

Family 7 Cellulase

The Family 7 cellulase may be derived from a strain of Humicola, preferably *H. insolens.* An example is endo-glucanase EG I derived from *H. insolens* strain DSM 1800, described in WO 91/17244 (Novo Nordisk). The mature cellulase has a sequence of the 415 amino acids shown at positions 21–435 in FIG. 14 of said document and has a specific activity of 200 ECU/mg (based on pure enzyme protein). This cellulase may further be truncated at the C-terminal by up to 18 amino acids to contain at least 397 amino acids. As examples, the cellulase may be truncated to 402, 406, 408 or 412 amino acids. Another example is a variant thereof denoted endo-glucanase EG I* described in WO 95/24471 (Novo Nordisk) and having a sequence of 402 amino acids shown in FIG. 3 therein.

Alternatively, the Family 7 cellulase may be derived from a strain of Myceliophthora, preferably *M. thermophila,* most preferably the strain CBS 117.65. An example is an endo-glucanase described in WO 95/24471 (Novo Nordisk) comprising the amino acids 21–420 and optionally also the amino acids 1–20 and/or 421–456 of the sequence shown in FIG. 6 therein.

As another alternative, the Family 7 cellulase may be derived from a strain of Fusarium, preferably *F. oxysporum.* An example is an endo-glucanase derived from *F. oxysporum* described in WO 91/17244 (Novo Nordisk) and Sheppard, P.O. et al., *Gene.* 150:163–167, 1994. The correct amino acid sequence is given in the latter reference. This cellulase has a specific activity of 350 ECU/mg.

Family 12 Cellulase

A preferred Family 12 cellulase without CBD is CMC 1 derived from *Humicola insolens* DSM 1800, described in WO 93/11249 (Novo Nordisk).

Another preferred Family 12 cellulase without CBD is EG III cellulase from Trichoderma, particularly *Trichoderma viride* or *Trichoderma reesei*, described in WO 92/06184 (Genencor).

Alternatively, the Family 12 cellulase may be derived from a strain of Myceliophthora, preferably *M. thermophila*, most preferably the strain CBS 117.65. Such a cellulase (termed C173) can be produced by cloning DNA from CBS 117.65, and subsequently transforming *Aspergillus oryzae*, a non-cellulolytic host organism, and expressing the cellulase by cultivation of the transformed host, and separating the only cellulolytic active ingredient from the culture broth. C173 has optimum activity at pH 4–6.5, a specific activity of 226 ECU per mg protein and a molecular weight of 26 kDa (for the mature protein). The sequence of CDNA encoding C173 (from start codon to stop codon) and the amino acid sequence of the mature protein of C173 are shown in the sequence listing as SEQ ID NO: 1 and 2.

Family 45 Cellulase

A preferred Family 45 cellulase without CBD is the EG V-core derived from *Humicola insolens*, described in Boisset, C., Borsali, R., Schulein, M., and Henrissat, B., FEBS Letters. 376:49–52, 1995. It has the amino acid sequence shown in positions 1–213 of SEQ ID NO: 1 of WO 91/17243 (Novo Nordisk).

Another preferred Family 45 cellulase without CBD is FI-CMCase from *Aspergillus aculeatus* described by Ooi et al., Nucleic Acids Research, Vol. 18, No. 19, p. 5884 (1990).

Single-component Cellulase

Single component enzymes can be prepared economically by recombinant DNA technology, i.e. they can be produced by cloning of a DNA sequence encoding the single component, subsequently transforming a suitable host cell with the DNA sequence and expressing the component in the host. Accordingly, the DNA sequence encoding a useful cellulase may be isolated by a general method involving cloning, in suitable vectors, a DNA library e.g. from one of the microorganisms indicated later in this specification, transforming suitable yeast host cells with said vectors, culturing the host cells under suitable conditions to express any enzyme of interest encoded by a clone in the DNA library, screening for positive clones by determining any cellulase activity of the enzyme produced by such clones, and isolating the enzyme encoding DNA from such clones.

The general method is further disclosed in WO 94/14953 the contents of which are hereby incorporated by reference.

The DNA sequence coding for a useful cellulase may for instance be isolated by screening a cDNA library of the microorganism in question and selecting for clones expressing the appropriate enzyme activity (i.e. cellulase activity).

A DNA sequence coding for a homologous enzyme, i.e. an analogous DNA sequence, may be obtainable from other microorganisms. For instance, the DNA sequence may be derived by similarly screening a cDNA library of another fungus, such as a strain of an Aspergillus sp., in particular a strain of *A. aculeatus* or *A. niger*, a strain of Trichoderma sp., in particular a strain of *T. reesei, T. viride, T. longibrachiatum, T. harzianum* or *T. koningii* or a strain of a Neocallimastix sp., a Piromyces sp., a Penicillium sp., an Agaricus sp., or a Phanerochaete sp.

Alternatively, the DNA coding for a useful cellulase may, in accordance with well-known procedures, conveniently be isolated from DNA from a suitable source, such as any of the above mentioned organisms, by use of synthetic oligonucleotide probes prepared on the basis of a known DNA sequence.

The DNA sequence may subsequently be inserted into a recombinant expression vector. This may be any vector which may conveniently be subjected to recombinant DNA procedures, and the choice of vector will often depend on the host cell into which it is to be introduced. Thus, the vector may be an autonomously replicating vector, i.e. a vector which exists as an extra-chromosomal entity, the replication of which is independent of chromosomal replication, e.g. a plasmid. Alternatively, the vector may be one which, when introduced into a host cell, is integrated into the host cell genome and replicated together with the chromosome(s) into which it has been integrated.

In the vector, the DNA sequence encoding the cellulase should be operably connected to a suitable promoter and terminator sequence. The promoter may be any DNA sequence which shows transcriptional activity in the host cell of choice and may be derived from genes encoding proteins either homologous or heterologous to the host cell. The procedures used to ligate the DNA sequences coding for the cellulase, the promoter and the terminator, respectively, and to insert them into suitable vectors are well known to persons skilled in the art (cf., for instance, Sambrook et al., Molecular Cloning. A Laboratory Manual, Cold Spring Harbor, N.Y., 1989).

The host cell which is transformed with the DNA sequence is preferably a eukaryotic cell, in particular a fungal cell such as a yeast or filamentous fungal cell. In particular, the cell may belong to a species of Aspergillus or Trichoderma, most preferably *Aspergillus oryzae* or *Aspergillus niger*. Fungal cells may be transformed by a process involving protoplast formation and transformation of the protoplast followed by regeneration of the cell wall in a manner known per se. The use of Aspergillus as a host microorganism is described in EP 238 023 (Novo Nordisk A/S), the contents of which are hereby incorporated by reference. The host cell may also be a yeast cell, e.g. a strain of Saccharomyces, in particular *Saccharomyces cerevisiae, Saccharomyces kluyveri* or *Saccharomyces uvarum*, a strain of Schizosaccharomyces sp., such as *Schizosaccharomyces pombe*, a strain of Hansenula sp., Pichia sp., Yarrowia sp. such as *Yarrowia lipolytica*, or Kluyveromyces sp. such as *Kluyveromyces lactis*.

In the present context, the term "homologous" or "homologous sequence" is intended to indicate an amino acid sequence differing from those shown in each of the sequence listings shown hereinafter, respectively, by one or more amino acid residues. The homologous sequence may be one resulting from modification of an amino acid sequence shown in these listings, e.g. involving substitution of one or more amino acid residues at one or more different sites in the amino acid sequence, deletion of one or more amino acid residues at either or both ends of the enzyme or at one or more sites in the amino acid sequence, or insertion of one or more amino acid residues at one or more sites in the amino acid sequence.

However, as will be apparent to the skilled person, amino acid changes are preferably of a minor nature, that is conservative amino acid substitutions that do not significantly affect the folding or activity of the protein, small deletions, typically of one to about 30 amino acids; small amino- or carboxyl-terminal extensions, such as an amino-terminal methionine residue, a small linker peptide of up to about 20–25 residues, or a small extension that facilitates purification, such as a poly-histidine tract, an antigenic epitope or a binding domain. See in general Ford et al., Protein Expression and Purification 2:95–107, 1991. Examples of conservative substitutions are within the group of basic amino acids (such as arginine, lysine, histidine), acidic amino acids (such as glutamic acid and aspartic acid), polar amino acids (such as glutamine and asparagine), hydrophobic amino acids (such as leucine, isoleucine, valine), aromatic amino acids (such as phenylalanine, tryptophan, tyrosine) and small amino acids (such as glycine, alanine, serine, threonine, methionine).

It will also be apparent to persons skilled in the art that such substitutions can be made outside the regions critical to the function of the molecule and still result in an active polypeptide. Amino acids essential to the activity of the polypeptide encoded by the DNA construct of the invention, and therefore preferably not subject to substitution, may be identified according to procedures known in the art, such as site-directed mutagenesis or alanine-scanning mutagenesis (Cunningham and Wells, Science 244, 1081–1085, 1989). In the latter technique mutations are introduced at every residue in the molecule, and the resultant mutant molecules are tested for biological (i.e. cellulase) activity to identify amino acid residues that are critical to the activity of the molecule. Sites of substrate-enzyme interaction can also be determined by analysis of crystal structure as determined by such techniques as nuclear magnetic resonance, crystallography or photoaffinity labeling. See, for example, de Vos et al., Science 255: 306–312, 1992; Smith et al., *J. Mol. Biol.* 224: 899–904, 1992; Wlodaver et al., FEBS Lett. 309: 59–64, 1992.

The modification of the amino acid sequence may suitably be performed by modifying the DNA sequence encoding the enzyme, e.g. by site-directed or by random mutagenesis or a combination of these techniques in accordance with well-known procedures. Alternatively, the homologous sequence may be one of an enzyme derived from another origin than the cellulases corresponding to the amino acid sequences shown in each of the sequence listings shown hereinafter, respectively. Thus, "homologue" may e.g. indicate a polypeptide encoded by DNA which hybridizes to the same probe as the DNA coding for the cellulase with the amino acid sequence in question under certain specified conditions (such as presoaking in 5×SSC and prehybridising for 1 h at ~40° C. in a solution of 20% formamide, 5×Denhardt's solution, 50 mM sodium phosphate, pH 6.8, and 50 mg of denatured sonicated calf thymus DNA, followed by hybridization in the same solution supplemented with 100 mM ATP for 18 h at ~40° C.). The homologous sequence will normally exhibit a degree of homology (in terms of identity) of at least 50%, such as at least 60%, 65%, 70%, 75%, 80%, 85%, 90% or even 95% with the amino acid sequences shown in each of the sequence listings shown hereinafter, respectively.

The homology referred to above is determined as the degree of identity between the two sequences indicating a derivation of the first sequence from the second. The homology may suitably be determined by means of computer programs known in the art such as GAP provided in the GCG program package (Needleman, S. B. and Wunsch, C. D., *Journal of Molecular Biology,* 48: 443–453, 1970).

Process Conditions

The process conditions should be selected according to the characteristics of the cellulase to be used. For the cellulases described above, the following conditions can generally be used: pH 4–9.5 (e.g. 5–9.5, particularly 6–8), 10–70° C. (particularly 30–50° C.) and a reaction time of 30 minutes–5 hours. The pulp consistency will generally be in the range 0.3–40% (typically 2–20%), particularly in the range 2–10% for non-recycled pulp and 10–20% for pulp from recycled waste paper. For typical process conditions, the cellulase is used at a dosage of 50–2,000 ECU/kg pulp dry matter, particularly 100–1,000 ECU/kg (ECU unit defined below).

The pulp may optionally be beaten or refined in a conventional beater or refiner, either before, during or after the treatment with cellulase; it is generally preferred to avoid excessive beating or refining as it tends to reduce the softness of the sanitary paper, and in some cases beating or refining may be omitted.

After the cellulase treatment, the sanitary paper can be made from the treated pulp in a conventional papermaking machine.

Assay for Cellulase Activity (ECU)

The cellulase endo-activity is determined by the reduction of viscosity of CMC (carboxy-methyl cellulose) in a vibration viscosimeter. 1 ECU (endo-cellulase unit) is the amount of activity which causes a 10-fold reduction of viscosity when incubated with 1 ml of a solution of 34.0 g/L of CMC (trade name Aqualon 7LFD) in 0.1 M phosphate buffer (pH 7.5), 40° C. for 30 minutes.

EXAMPLES

Example 1

The pulp used in this example was a 1:1 mixture of NBKP and LBKP. The NBKP was made from a southern softwood mixture of pine (Caribbean and Monterey), Douglas fir and redwood. The LBKP was made from hardwood containing maple, alder, birch, hickory and aspen. The coarseness was 19.3 for the NBKP and 16.8 for the LBKP.

The cellulase used in this example was EG I from *Humicola insolens* DSM 1800 (Family 7). The following conditions were used:

Pulp consistency: 5% w/w pH: 7

Temperature: 40° C.

Reaction time: 2 hours

Stirring: 350 rpm.

Handsheets were prepared from the treated pulp according to Japan Industrial Standard, JIS 8209. Sheets of 20 g/m$^2$ were tested for stiffness (Japanese Industrial Standard, JIS P8143), and sheets of 60 g/m$^2$ were tested for breaking length (JIS P8113).

The table below gives the absolute values of stiffness and breaking length for a control treated without cellulase. For the experiments with cellulase treatment, the table shows the relative change (in %) of these values compared to the control. Thus, ideally, the stiffness should decrease, while the breaking length should increase or remain constant.

| | Cellulase | Dosage, ECU per kg dry matter | Stiffness | Breaking length |
|---|---|---|---|---|
| Control (absolute values) | None | 0 | 22.75 | 2.11 |
| Invention (% change) | Family 7 | 150 | −30% | −2% |
| | | 225 | −22% | −3% |
| | | 300 | −37% | −2% |

The above results demonstrate that a cellulase treatment according to the invention gave a decreased stiffness, i.e. a softer paper. The paper strength (breaking length) was nearly unchanged. The best results were obtained at a dosage of 300 ECU/kg pulp dry matter.

Example 2

The pulp used in this experiment was a 50:50 mixture of NBKP having a coarseness of 15.8 and LBKP having a coarseness of 8.5. The NBKP was made from a northern softwood mixture of fir, spruce, ponderosa pine, cedar and hemlock, and the LBKP was made from a hardwood mixture of acacia and eucalyptus. The pulp was treated in the same manner as in Example 1 at the enzyme dosages shown below. Results:

| | Cellulase | Dosage (ECU per kg dry matter) | Stiffness | Breaking length |
|---|---|---|---|---|
| Control (absolute values) | None | 0 | 21.2 | 2.19 |
| Invention (% change) | Family 7 | 300 | −16% | −2% |
| | | 600 | −33% | +18% |

Advantageously, the results with this pulp show that at the highest dosage tested, the sanitary paper became significantly softer and stronger.

Example 3

The pulp used in Example 1 was treated with the following cellulases according to the invention: C173 from *Myceliophthora thermophila (Family* 12), EG V-core from *Humicola insolens* (Family 45). The pulp was treated at pH 6 since this is close to the optimum pH for the cellulases.

Other process conditions were: Pulp consistency 3% w/w, temperature 30° C., reaction time 2 hours, stirring 400 rpm. Handsheets were prepared and tested as in Example 1. The results are shown as absolute value for the control, and % change (compared to the control) for the other experiments.

| | Cellulase | Dosage (ECU/kg dry matter) | Stiffness | Breaking length |
|---|---|---|---|---|
| Control (absolute value) | None | 0 | 25.2 | 1.92 |
| Invention (% change) | Family 12 | 300 | −23% | +1% |
| | | 600 | −23% | +4% |
| | Family 45 | 300 | −3% | +3% |
| | | 600 | −29% | +12% |

The results above show that both cellulases according to the invention are effective for making the sanitary paper softer and stronger.

Example 4

EG I from *Humicola insolens* DSM 1800 (Family 7) was tested at the same conditions as in Example 3, except that a pH 7 was selected as being suitable for this cellulase.

| | Cellulase | Dosage (ECU/kg dry matter) | Stiffness | Breaking length |
|---|---|---|---|---|
| Control (absolute value) | None | 0 | 18.2 | 1.73 |
| Invention (% change) | Family 7 | 300 | −21% | −3% |
| | 600 | −10% | +3% | |

This example was made with the same pulp and cellulase as in Example 1, but at different conditions (temperature, pulp consistency, stirring and dosage) . The results show that also at these compositions, the cellulase treatment gave a softer paper with nearly unchanged strength. The best result was obtained at a dosage of 300 ECU/kg pulp dry matter.

SEQUENCE LISTING (1) GENERAL INFORMATION:

(iii) NUMBER OF SEQUENCES: 2

(2) INFORMATION FOR SEQ ID NO:1:

(i) SEQUENCE CHARACTERISTICS:
(A) LENGTH: 744 base pairs
(B) TYPE: nucleic acid
(C) STRANDEDNESS: single
(D) TOPOLOGY: linear (xi) SEQUENCE DESCRIPTION: SEQ ID NO:1:

```
ATGCAGCCGT TTCTGCTCTT GTTCCTCTCG TCGGTCACGG CGGCGAGCCC CCTGACGGCG    60

CTCGACAAGC GGCAGCAGGC GACGTTGTGC GAGCAGTACG GCTACTGGTC GGGCAACGGT   120

TACGAGGTCA ACAACAACAA CTGGGGCAAG GATTCGGCCT CGGGCGGCCA TCAGTGCACC   180

TACGTCGACA GCAGCAGCTC CAGCGGCGTC GCCTGGCACA CGACCTGGCA GTGGGAAGGA   240

GGCCAGAACC AGGTCAAGAG CTTCGCCAAC TGCGGTCTGC AGGTGCCCAA GGGCAGGACC   300

ATCTCGTCCA TCAGCAACCT GCAGACCTCC ATCTCGTGGT CCTACAGCAA CACCAACATC   360

CGCGCCAACG TGGTCTACGA CCTCTTCACC GCGGCAGACC CGAACCACGC GACCAGCAGC   420

GGCGACTACG AGCTCATGAT CTGGCTGGCG AGATTCGGCG ACGTCTACCC CATCGGCTCG   480

TCCCAGGGCC ACGTCAACGT GGCCGGCCAG GACTGGGAGC TGTGGACGGG CTTCAACGGC   540

AACATGCGGG TCTACAGCTT CGTAGCGCCC AGCCCCCGCA ACAGCTTCAG CGCCAACGTC   600

AAGGACTTCT TCAACTATCT CCAGTCCAAC CAGGGCTTCC CGGCCAGCAG CCAATACCTT   660

CTCATCTTCC AGGCGGGCAC CGAGCCCTTC ACCGGCGGCG AGACCACCCT TACCGTCAAC   720

AACTACTCTG CAAGGGTTGC TTAA                                          744
```

(2) INFORMATION FOR SEQ ID NO:2:

(i) SEQUENCE CHARACTERISTICS:
(A) LENGTH: 246 amino acids
(B) TYPE: amino acid
(C) STRANDEDNESS: single
(D) TOPOLOGY: linear (xi) SEQUENCE DESCRIPTION: SEQ ID NO:2:

```
Met Gln Pro Phe Leu Leu Leu Phe Leu Ser Ser Val Thr Ala Ala Ser
 1               5                  10                  15

Pro Leu Thr Ala Leu Asp Lys Arg Gln Gln Ala Thr Leu Cys Glu Gln
            20                  25                  30

Tyr Gly Tyr Trp Ser Gly Asn Gly Tyr Glu Val Asn Asn Asn Asn Trp
        35                  40                  45

Gly Lys Asp Ser Ala Ser Gly Gly His Gln Cys Thr Tyr Val Asp Ser
    50                  55                  60

Ser Ser Ser Ser Gly Val Ala Trp His Thr Thr Trp Gln Trp Glu Gly
65                  70                  75                  80

Gln Asn Gln Val Lys Ser Phe Ala Asn Cys Gly Leu Gln Val Pro Lys
                85                  90                  95

Gly Arg Thr Ile Ser Ser Ile Ser Asn Leu Gln Thr Ser Ile Ser Trp
            100                 105                 110
```

-continued

```
Ser Tyr Ser Asn Thr Asn Ile Arg Ala Asn Val Val Tyr Asp Leu Phe
        115                 120                 125

Thr Ala Ala Asp Pro Asn His Ala Thr Ser Ser Gly Asp Tyr Glu Leu
    130                 135                 140

Met Ile Trp Leu Ala Arg Phe Gly Asp Val Tyr Pro Ile Gly Ser Ser
145                 150                 155                 160

Gln Gly His Val Asn Val Ala Gly Gln Asp Trp Glu Leu Trp Thr Gly
                165                 170                 175

Phe Asn Gly Asn Met Arg Val Tyr Ser Phe Val Ala Pro Ser Pro Arg
            180                 185                 190

Asn Ser Phe Ser Ala Asn Val Lys Asp Phe Phe Asn Tyr Leu Gln Ser
        195                 200                 205

Asn Gln Gly Phe Pro Ala Ser Ser Gln Tyr Leu Leu Ile Phe Gln Ala
    210                 215                 220

Gly Thr Glu Pro Phe Thr Gly Gly Glu Thr Thr Leu Thr Val Asn Asn
225                 230                 235                 240

Tyr Ser Ala Arg Val Ala
                245
```

What is claimed is:

1. A method making sanitary paper, comprising:

(a) treating a chemical papermaking pulp with a single component cellulase that lacks a cellulose-binding domain in amount effective to increase the softness of the sanitary paper made from the chemical papermaking pulp, and (b) making the sanitary paper from the treated pulp, wherein the sanitary paper exhibits (i) increased softness and (ii) unchanged or increased strength, when (I) and (ii) are compared with a control sanitary paper made from the same pulp and treated with a cellulase that contains a cellulose-binding domain.

2. The method of claim 1 wherein the cellulase belongs to Family 12.

3. The method of claim 2, wherein the cellulase is a cellulase derived from Myceliophthora.

4. The method of claim 2, wherein the cellulase has the amino acid sequence shown in SEQ ID NO: 2 or has at least 60% homology with said sequence.

5. The method of claim 1 wherein the cellulase belongs to Family 45.

6. The method of claim 5, wherein the cellulase is truncated EG V derived from a strain of Humicola.

7. The method of claim 6, wherein said EG V is truncated to positions 1–213.

8. The method of claim 1, wherein the cellulase consists essentially of a single component.

9. The method of claim 1, wherein the papermaking pulp comprises 5–95% of softwood pulp and 5–95% of hardwood pulp.

10. The method of claim 9, wherein the papermaking pulp comprises softwood bleached Kraft pulp and hardwood bleached Kraft pulp.

11. The method of claim 1, wherein the papermaking pulp is prepared by disintegrating a dried pulp in water.

12. The method of claim 1, which does not include beating or refining of the papermaking pulp.

13. The method of claim 1, wherein the cellulase is used at a dosage of 50–2,000 ECU per kg of pulp dry matter.

14. The method of claim 1, wherein the treatment is carried out at a temperature in the range 10–70° C.

15. The method of claim 1, wherein the treatment is carried out at a pH in the range 4–9.5.

16. The method of claim 1, wherein the treatment is carried out for a period of 30 minutes–5 hours.

17. The method of claim 1, wherein the treatment is carried out at a pulp consistency of 0.3–40%.

18. The method of claim 1, wherein the cellulase belongs to Family 7.

19. The method of claim 1, wherein the cellulase is EG I derived from a strain of Humicola.

20. The method of claim 1, wherein the cellulase has an amino acid sequence comprising the amino acid residues 21–417 in the sequence of EG I from *H. insolens* DSM 1800 or is a cellulase having at least 60% homology with said sequence.

21. The method of claim 1, wherein the cellulase is derived from *H. insolens*.

22. The method of claim 1, wherein the cellulase is derived from *H. insolens* strain DSM 1800 or is a cellulase a having at least 60% homology with the cellulase derived from *H. insolens* strain DSM 1800.

* * * * *